US005836097A

United States Patent [19]

Lewis et al.

[11] Patent Number: 5,836,097

[45] **Date of Patent: *Nov. 17, 1998**

[54] UNIVERSAL SHELF DIVIDER, LABEL AND SIGN HOLDER SYSTEM

[75] Inventors: Kirk Lewis, Lee's Summit, Mo.; John Gebka; Michael Brinkman, both of Coral Springs, Fla.; Neil Speed, Nottingham, United Kingdom

[73] Assignee: FEMC Ltd., Ft. Lauderdale, Fla.

[ * ] Notice: This patent issued on a continued prosecution application filed under 37 CFR 1.53(d), and is subject to the twenty year patent term provisions of 35 U.S.C. 154(a)(2).

[21] Appl. No.: 630,833

[22] Filed: Apr. 10, 1996

[51] Int. Cl.[6] ..... G09F 3/20

[52] U.S. Cl. ..... 40/658; 40/661; 40/661.09; 24/67.11; 24/562; 24/563; 248/205.3; 248/316.7

[58] Field of Search ..... 40/594, 642.02, 40/658, 661, 661.03, 661.08, 661.09, 666; 24/67.11, 562, 563; 248/205.3, 316.7

[56] References Cited

U.S. PATENT DOCUMENTS

| | | | |
|---|---|---|---|
| 1,602,341 | 10/1926 | Day | 40/658 |
| 2,408,194 | 9/1946 | Bourdius | 40/658 X |
| 3,324,585 | 6/1967 | Frederickson | 40/658 |
| 3,828,402 | 8/1974 | Gorman | 24/67.11 X |
| 4,295,288 | 10/1981 | Westberg | 40/661 |
| 4,531,313 | 7/1985 | Fast . | |
| 4,625,441 | 12/1986 | Fast . | |
| 4,703,570 | 11/1987 | Fast . | |
| 4,716,669 | 1/1988 | Fast . | |

(List continued on next page.)

FOREIGN PATENT DOCUMENTS

| | | |
|---|---|---|
| 438895 | 7/1991 | European Pat. Off. . |
| 769044 | 2/1957 | United Kingdom . |
| 2092525 | 8/1982 | United Kingdom . |
| 2158141 | 11/1985 | United Kingdom . |
| 2249125 | 4/1992 | United Kingdom . |
| 2262179 | 5/1993 | United Kingdom . |

OTHER PUBLICATIONS

Fast Industries and Fast Extruding and Molding, Nonadhesive Label Applications Instruction Manual.

Fast Extruding and Molding Sell Sheet entitled Twist Strip™.

Fast Extruding and Molding Sell Sheet entitled "EZ–View Sign Holders".

Southern Imperial, Inc. Display Hooks, Label Holders, & Merchandising Accessories Catalog, pp. 48–52.

(List continued on next page.)

*Primary Examiner*—Brian K. Green

*Attorney, Agent, or Firm*—Jacobson, Price, Holman & Stern, PLLC

[57] ABSTRACT

A shelf divider, label and sign holder system comprising an elongated universal support element formed with a relatively rigid channel-shaped shell adapted to be adhesively mounted on a vertically or horizontally extending surface. The support element includes an extended cover portion with flexible fingers co-extruded therewith and adapted to engage the mounting surface itself to removably capture therebetween portions of an item to be supported by the support element. When used as a vertical surface sign holder system, the support element is generally horizontally secured to the vertical surface, with the channel opening downwardly and a paper, cardboard or plastic indicia-containing label or sign securely held at its upper edges between the flexible fingers and the vertical mounting surface. The same support element may be adhesively secured to the undersurface of a shelf juxtapositioned to the front edge thereof, for reception of a perpendicular mounting flange of an adhesive or non-adhesive label holder. Additionally, a pair of the universal support elements may be adhesively secured in spaced parallel relation to the upper surface of a shelf generally parallel to the elongated front and back edges thereof with their channels facing each other, for reception of mounting elements formed at the end of a flat flange, between which a perpendicularly extending divider member is supported.

12 Claims, 7 Drawing Sheets

U.S. PATENT DOCUMENTS

| | | | |
|---|---|---|---|
| 4,866,868 | 9/1989 | Kass . | |
| 4,899,974 | 2/1990 | Wear et al. . | |
| 4,942,968 | 7/1990 | Fast . | |
| 5,018,287 | 5/1991 | Fast | 40/661 X |
| 5,148,927 | 9/1992 | Gebka . | |
| 5,272,826 | 12/1993 | Gingras | 40/661 X |
| 5,390,435 | 2/1995 | Grody | 40/658 X |
| 5,421,113 | 6/1995 | Gebka et al. . | |

OTHER PUBLICATIONS

Fasteners For Retail, "1996 Buyers Guide", pp. 9–15, 20–21, 26–29, 43–45, 61, 66.

UNIVERSAL SHELF DIVIDER, LABEL AND SIGN HOLDER SYSTEM

BACKGROUND OF THE INVENTION

1. Field of the Invention

This invention relates to an integrated shelf divider, label and sign holder system and relates more particularly to an elongated universal support element, one or more of which may be adhesively affixed to a horizontal or vertical mounting surface, with flexible fingers adapted to directly engage the mounting surface to removably capture therebetween portions of an item to be supported thereby.

The universal support element of this invention can be mounted generally horizontally, on a vertically extending surface to secure a sheet of material, which may be formed of paper, cardboard or plastic, to the surface for display of a message or sign to a passerby.

Alternatively, a universal support element according to this invention can be secured to the undersurface of a generally horizontally extending shelf, adjacent the front edge thereof, to receive mounting portions of a label holder between the flexible fingers of the support element and the shelf undersurface. The label-holding portions of the label holder can then extend, either upwardly or downwardly, perpendicularly to the front edge of the shelf to convey information to a customer regarding the products carried on the upper surface of the shelf.

Additionally, a pair of such universal support elements can be affixed to the upper surface of a shelf, parallel the front and back longitudinally extending edges of the shelf, in spaced relationship to each other. Opposed end mounting portions of one or more elongated shelf dividers can then be slid between the flexible fingers of the support elements and the shelf surface, to position upstanding divider elements generally perpendicularly to the front and back edges and the upper surface of the shelf.

2. Description of Related Art

Various display devices are currently available from Fast Industries, Inc. and FEMC Ltd. of Fort Lauderdale, Fla., and others, for carrying cards, labels or signs adapted to present information to customers or other passersby.

Some such devices are elongated strip-type elements comprising a pair of opposed tension elements in the form of a U-shaped channel, including a pair of leg members, the outside surface of one of which may be adhesively secured to a generally vertically extending mounting surface and the inside surface of one or both of which is provided with flexible fingers adapted to engage each other or the inside surface of the other leg to removably capture therebetween portions of an item to be supported thereby. The mounting leg of such devices presents an edge portion which extends perpendicularly to the mounting surface requiring a sheet of paper, a label, a sign, or another item to be supported thereby, to be painstakenly inserted between the opposed legs for it to be properly held in place.

Prior art horizontal surface sign and label holder systems adapted for use with a shelf or the like frequently require the use of adhesive, push pins, clamps or other extraneous means, some of which are costly and most of which are temporary in nature. Where such devices are mounted in apertures in a shelf or where they attach to the front of a shelf, they sometimes interfere with product and branding information. Unused portions of channels adapted to receive pricing or inventory information, permanently or temporarily, that are attached to the forward edge of a shelf or the like tend to become dirty and unsightly. When elongated U-shaped elements of the type described above with reference to vertical surfaces are used to support a label holder on the undersurface of a shelf, they suffer the same principal disadvantage, i.e., they present an edge portion which makes it difficult to engage a mounting element on the label holder between the tension-providing elements.

Many types of shelf divider systems have been proposed heretofore, some of which are formed of molded plastic or metal and waste a good deal of shelf space by their very nature. Moreover, most commercially available molded plastic dividers are held in place by tall front tracks that interfere with placing and removing products from the shelf surface. Moreover, if such devices are formed of an opaque material, they block product information from the consumer.

Elongated shelf dividers in the nature of strips of thin plastic material divided by a lengthwise fold line are available from Fast Industries, Inc. and are shown in U.S. Pat. Nos. 4,942,968 and 5,148,927, the subject matter of each of which is incorporated herein in its entirety by reference. These products, like the molded plastic or metal shelf dividers, are useful for some purposes; however, they often require push pins and/or fold-down tabs adapted to engage in openings in the surface of a shelf. In some instances, shelves do not have such openings. In other instances, the openings are only at the front and the back of the shelf, making it difficult to utilize a short shelf divider when products on only a portion of the shelf are to be segregated.

In addition to the foregoing disadvantages of the prior art, the products available heretofore have served only a single purpose, that is, they have either been effective as a vertical surface sign holder, as a horizontal surface sign or label holder, or as a shelf divider, necessitating inventory of many different elements for performing these various functions.

SUMMARY OF THE INVENTION

It is therefor a primary object of the present invention to provide a universal shelf divider, label and sign holder system utilizing a versatile support element adapted 1) to be mounted on a vertical surface for removably carrying the upper portions of a sheet of material, or 2) to be mounted on the undersurface of a generally horizontally extending shelf or the like adjacent the front edge thereof, for removably carrying perpendicularly extending portions of a label holder, or 3) to be mounted on the upper surface of a shelf in spaced opposed pairs extending generally parallel to each other and to the front and rear edges of the shelf, for reception of mounting tabs at the end of upstanding shelf divider elements extending perpendicularly to the front edge of the shelf.

A further object of this invention is the provision of a mounting element capable of such universal adaptation, wherein the mounting element relies on the mounting surface to provide the opposing tension for securing elements engaged by the flexible fingers.

Another object of this invention is the provision of a mounting element adapted for supporting a sheet of paper, a cardboard or plastic sign or label, or a portion of a separate label holder or shelf divider element, wherein the item to be secured thereby can be slid along the mounting surface into engagement with the flexible fingers with very little difficulty.

More specifically, it is an important object of this invention to provide a universal support element where portions of the item to be supported thereby are captured between flexible fingers and the mounting surface itself, thereby avoiding the need for the opposed tension-providing legs of prior art devices. This construction enables the provision of a relatively flat mounting element which allows the mounting portions of the supported element to be slid along the mounting surface for engagement by flexible fingers without engaging any obstacle.

Still another object of this invention is the provision of a horizontal surface sign and label holder system which is hidden on the undersurface of a shelf, so that unnecessary signs or label holders can be removed while retaining the mounting element in position for future use. Moreover, with the mounting element adhered to the underside of the horizontal surface of a shelf product and branding interference is avoided.

A further object of this invention is to provide a shelf divider system utilizing thin plastic die-cut divider elements which minimize shelf space wasted by the divider itself as is the case in many prior art metal and molded plastic divider systems.

A related object is the provision of a shelf divider system capable of use on shelves of any construction, with or without apertures, wherein the mounting elements are flat so as not to interfere with product accessibility, both visually and physically.

Yet another object of this invention is the provision of a unique shelf divider system, wherein the mounting elements for the shelf dividers can be installed at any depth between the front and the back edges of the shelf, making the system more cost efficient and enabling the provision of shelf dividers over only a portion of the shelf when appropriate for low in-store inventory levels.

BRIEF DESCRIPTION OF THE DRAWINGS

The above and still further objects, features and advantages of the present invention will be readily understood or become apparent upon consideration of the following detailed description of the referred embodiments hereof, especially when taken in conjunction with the accompanying drawings wherein.

DESCRIPTION OF THE PREFERRED EMBODIMENT(S)

Figure 1:
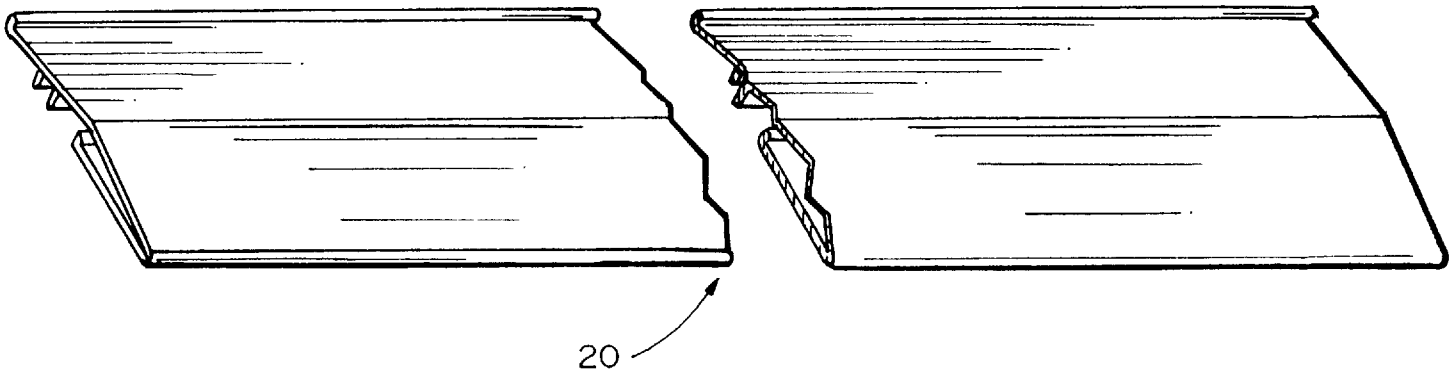
FIG. 1 is a fragmentary perspective view of an elongated universal support element adapted to display signage or label information parallel or perpendicularly to a horizontal or vertical mounting surface, and also adapted, when used in opposed pairs, to support upstanding shelf divider elements.
Figure 2:
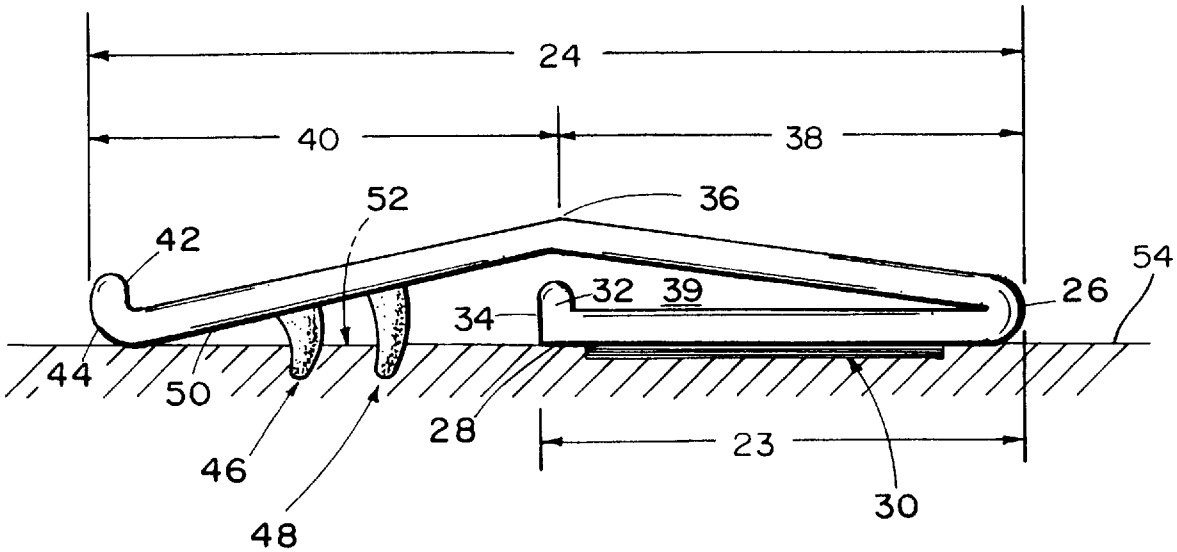
FIG. 2 is an enlarged end elevational view thereof.

Referring now to the drawings, wherein like parts are identified by like characters, and more particularly to FIGS. 1 and 2, an elongated universal support element is designated generally by the reference numeral 20 and comprises a relatively hard plastic shell including a mounting portion or element 22 and a cover portion or element 24 integrally connected along one longitudinal edge at 26. The connection 26, being formed of plastic, functions somewhat as a rather stiff hinge, permitting slight movements between the mounting and cover portions 22, 24, while biasing these elements toward their extruded configuration.

The mounting element 22 has a generally planar outer surface 28 carrying a strip of pressure-sensitive adhesive tape or the like 30 which may be covered with a release paper (not shown) in a well known manner. An upstanding flange 32 is integrally formed at the free edge of the mounting element 22 to provide a vertically extending surface 34 which functions as a stop for portions of an item captured by the support element 20.

The cover portion 24 is generally V-shaped with an apex 36 overlying the flange 32. A first part 38 of the cover 24 between the apex 36 and the connection 26 overlies, and is spaced from, the mounting element 22 to define therebetween a generally V-shaped channel member 39. A second part 40 of the cover element 24 extends beyond the channel member 39 and terminates in an upturned lip 42 defining an arcuate lower surface 44 to facilitate sliding thereunder a portion of an item to be supported by the support element 20.

Co-extruded with the hard plastic shell of the mounting element 20 in a well known manner is at least one, and preferably a pair of, elongated fingers 46, 48 formed of a more flexible plastic material and extending from the inner surface 50 of the second part 40 of the cover 24. The fingers 46, 48 have longitudinal axis parallel to the upturned lip 42 on the free outer edge of the cover 24 and are spaced therefrom and from each other to define a groove 52 between the fingers for a purpose to be described hereinafter.

It is to be noted that, because of the inclined nature of the second part 40 of the cover 24 of the mounting element 20, the length of the fingers 46, 48 are different, but each finger is somewhat longer than the space between the inside surface 50 of the second part 40 of the cover member 24 to which it is attached, and a line or plane coincident with the outer surface 28 of the mounting portion 22 of the support element 20 which is illustrated in FIG. 2 as a mounting surface 54. Thus, when the mounting element 20 is adhesively secured to the mounting surface 54, which may be either horizontally or vertically extending, the flexible terminal portions of the finger member(s) are biased into engagement with the mounting surface 54 to capture directly therebetween portions of an item to be supported by the support element 20. This construction avoids the need for part of the mounting element 22 to underly the finger(s) which would present an obstacle to simply sliding portions of the item to be supported along the mounting surface until they are captured by the finger(s).

As is evident from the drawing, the width of the cover portion 24 of the support element 20 between its longitudinally extending edges is greater than the width of the mounting portion 22, so that the second part 40 of the cover 24 extends beyond the outer edge or surface 34 of the mounting portion 30, i.e., extends further from the apex 26 than the channel 39. Although the dimensions may vary without departing from the instant inventive concepts, the mounting portion 22 may be approximately 0.5" wide, with the cover 24 being slightly less than twice that width. Sections of mounting elements 20 may be provided of any desirable length such as, for example, 4' or the like, such sections being cut to length, if desired, by the ultimate user.

Figure 3:
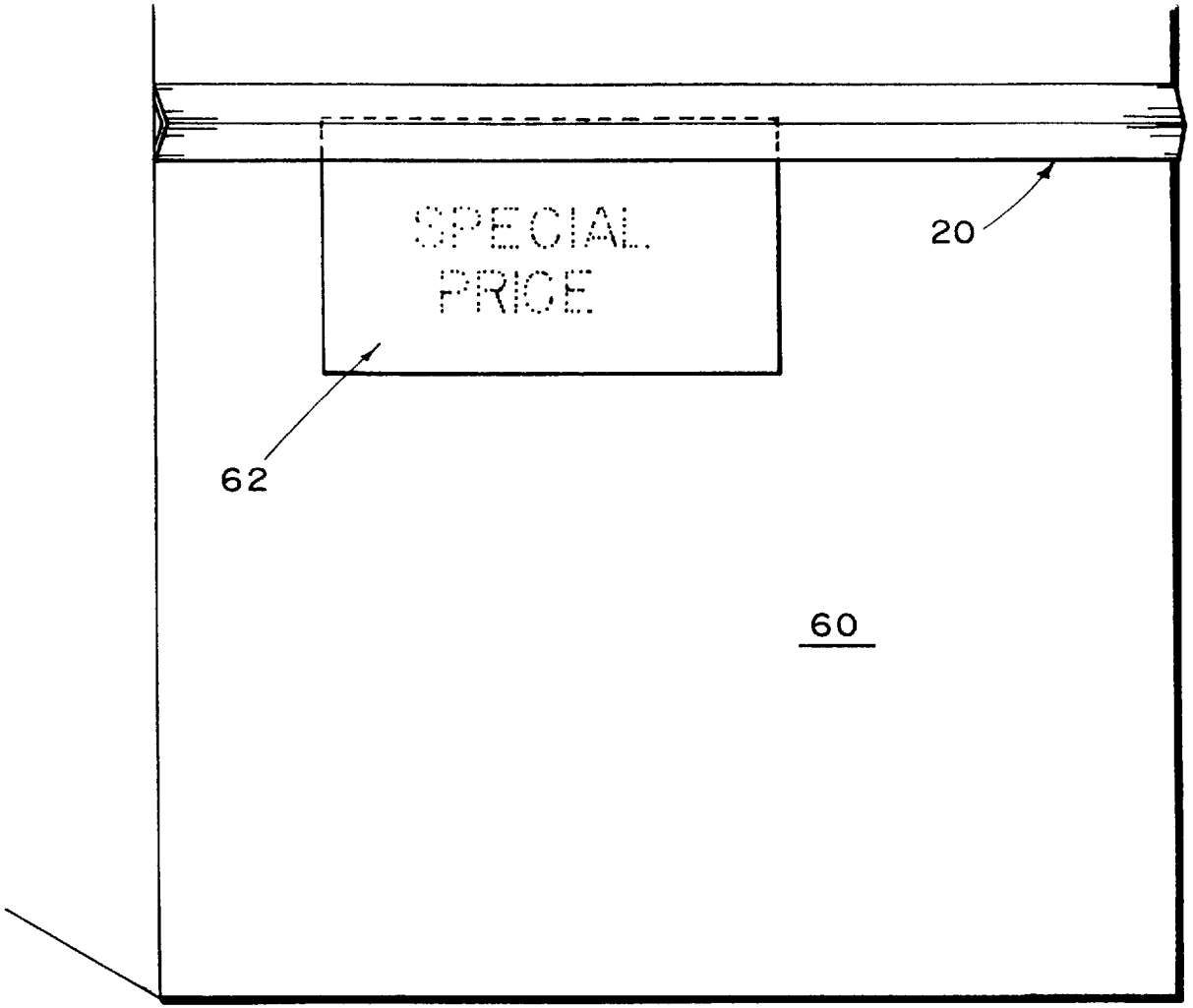
FIG. 3 is a perspective view showing the use of the support element of FIGS. 1 and 2 as a vertical surface sign holder.

Also, the materials and thickness of the wall portions of the individual parts of the mounting element 20 can be modified depending upon the particular properties necessary for specific applications. For most applications, however, the mounting and cover portions can be satisfactorily extruded from a relatively rigid polyvinyl chloride or butyrate to provide a rigid outer shell having a wall thickness of approximately 3–3.5 mil., with the gripping fingers 46, 48 co-extruded from a relatively flexible polyvinyl chloride Referring now to FIG. 3, it will be seen that a support element 20 can be secured by the adhesive tape 30 in a generally horizontally extending fashion to a generally vertically extending surface 60 with its channel member 39 opening downwardly. A sign or even a very flexible sheet of material such as paper 62, can be readily slid under the arcuate surface 44 of the cover 24 to be captured between the flexible terminal portions of the fingers 46 and/or 48 and the surface 60. The vertical surface 34 of the flange 32 on the freely extending longitudinal edge of the mounting portion 22 acts as a stop to properly position the sign 62, but there is no obstacle for the sign 62 to override before it is securely supported, since the mounting surface 60 itself is used to define the opposing tension for the flexible fingers 46, 48.

Of course, if desired, the support element 20 can be inverted to support a somewhat stiffer sign or the like from below (not shown).

Reference is now made particularly to FIGS. 4–7 for an explanation of the manner in which the universal support member 20 of this invention is used in a horizontal surface sign and label holder system. First, with reference to FIG. 4, a label holder for an adhesive label or sign is designated generally by the reference numeral 70 and comprises a thin plastic sheet formed of polyvinyl chloride or the like, bent at 72 to form a mounting element 74 and a generally perpendicularly extended label-receiving element 76 to which an adhesive label or sign 78 may be attached.

Figure 5:
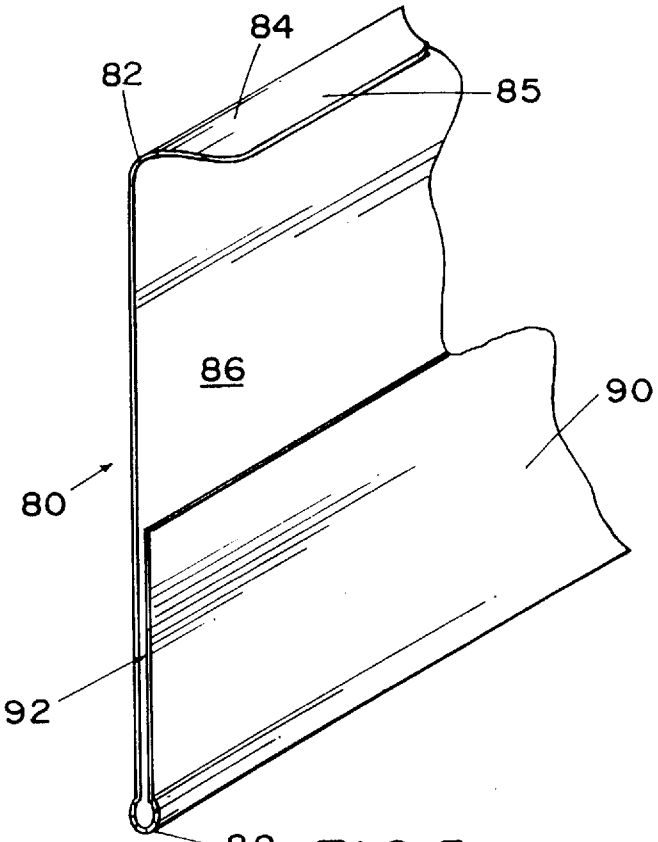
FIG. 5 is a fragmentary perspective view of a label holder similar to that shown in FIG. 4, but adapted to receive and hold non-adhesive labels and signs.
Figure 4:
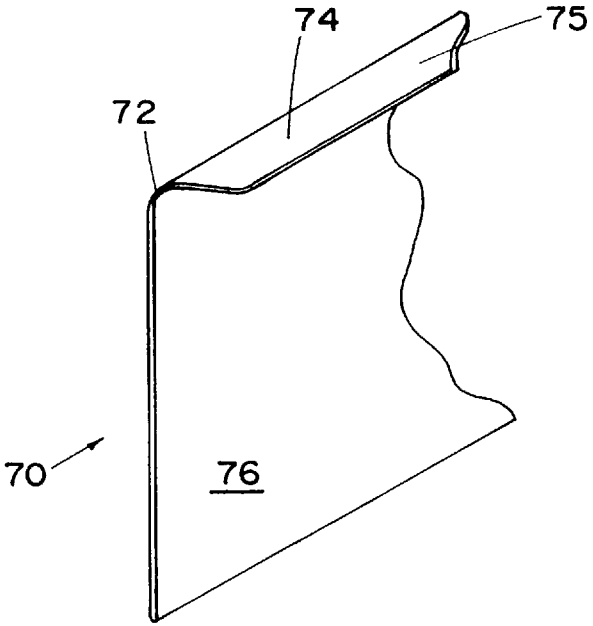
FIG. 4 is a fragmentary perspective view of a label holder adapted to receive adhesive labels, and to be mounted adjacent the edge of a shelf by the universal support element of this invention.

Alternatively, as shown in FIG. 5, a modified label holder 80 may be provided for carrying a non-adhesive label or sign. The label holder 80 is also formed of a thin plastic sheet material and comprises a first bend 82 forming a mounting element 84 extending at a right angle to a transparent panel 86, and a second bend 88 at the opposite end of the transparent panel 86 to form a reverted portion 90 defining a pocket 92 behind the transparent panel 86 for sliding reception of a non-adhesive label or sign 94.

Figures 6, 7:
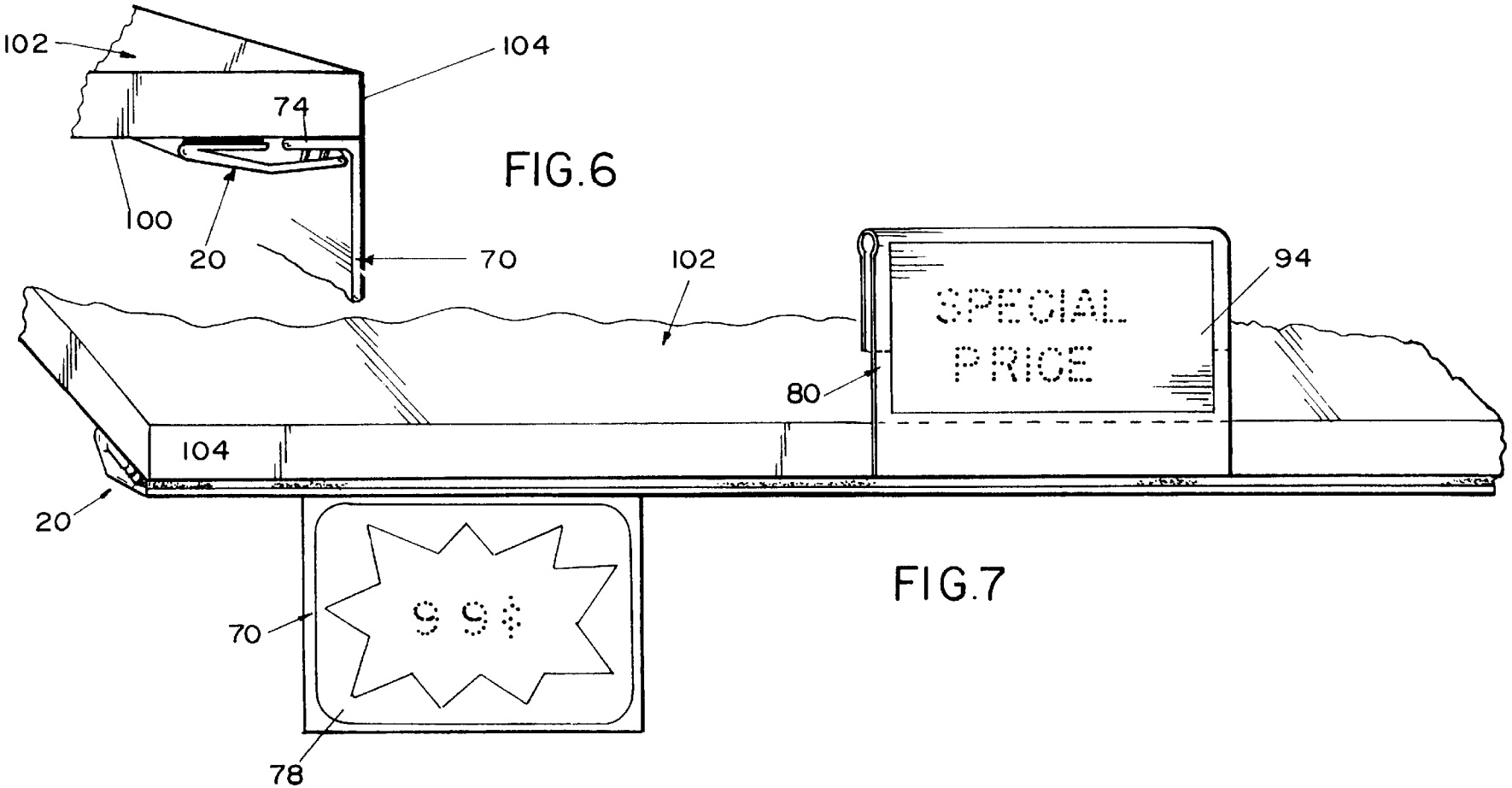
FIG. 6 is a fragmentary perspective view showing the manner in which the mounting portion of a label holder would be captured by the universal support element on the undersurface of a shelf according to this invention.
FIG. 7 is a perspective view showing a single universal support element supporting both a downwardly depending adhesive label holder such seen in FIG. 4 and an upwardly extending non-adhesive label holder of the type illustrated in FIG. 5.

With reference particularly to FIGS. 6 and 7, it will be seen how a universal support element 20 may be adhesively secured by the tape 30 to the undersurface 100 of a shelf 102 adjacent the front edge 104 thereof with its channel 39 facing the aisle. The mounting element 74 or 84 of an adhesive or non-adhesive label holder 70 or 80 can be captured between the flexible terminal portions of the fingers 46, 48 of the mounting element 20 and the undersurface 100 of the shelf 102, with the label-holding portion 76 or 86 extending downwardly or upwardly therefrom, as desired. See FIG. 7.

To enhance the engagement of either label holder with the universal support element 20, the mounting portions 74, 84 can be provided with die-pressed protuberances or elongated humps 75, 85, for reception in the groove 52 formed between the flexible fingers 46, 48.

Once again, the vertical surface 34 of the flange 32 of the mounting portion 22 of the mounting element 20 acts as a stop to facilitate positioning the label holders 70, 80. Yet, there is no obstacle to insertion of the mounting portions 74, 84 into the mounting element 20, because the undersurface 100 of the shelf 102 is used as the opposing tension surface, rather than a portion of mounting element itself as in prior art devices.

Figure 8:
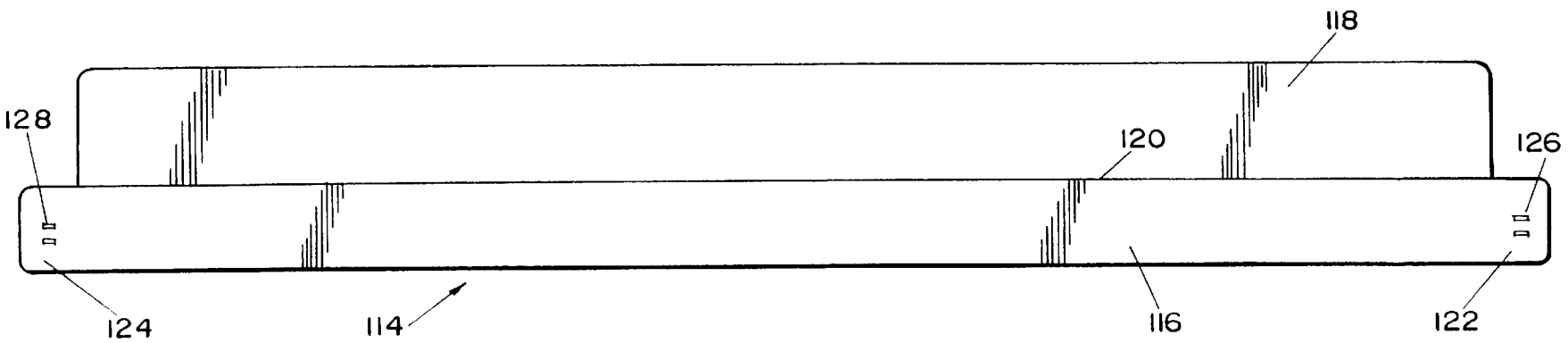
FIG. 8 is an elevational view of a blank which can be folded to form a shelf divider member which may be secured to the upper surface of a shelf by a pair of universal support elements according to the instant inventive concepts.
Figure 9:
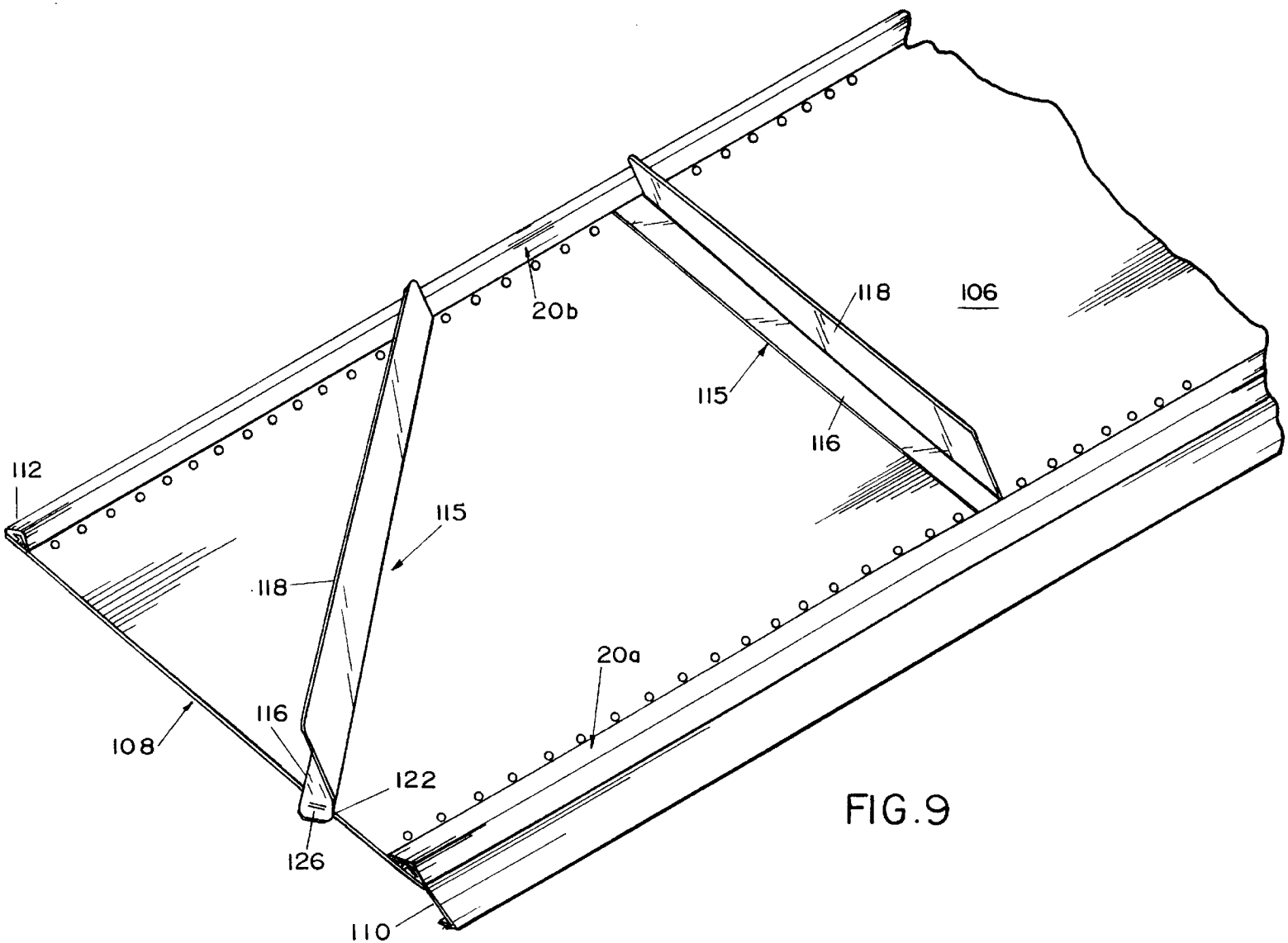
FIG. 9 is a perspective view showing one shelf divider member secured in position on the upper surface of a shelf, and a second shelf divider member being engaged in the mounting elements.

Finally, reference is made to FIGS. 8 and 9 for a discussion of the use of the universal support member 20 of this invention as part of a system to selectively divide the upper surface 106 of a shelf 108 having front and rear longitudinally extending edges 110, 112, respectively. In FIG. 8, a blank 114 of thin plastic sheet material is provided for forming an elongated shelf divider 115. The blank 114 may be bent along a fold line 120 to form a perpendicularly extending support member 116 and divider member 118 as seen in FIG. 9. The support member 116 of the divider 115 is longer than the divider member 118 so that the opposed end portions thereof define mounting elements 122, 124, each of which may be provided, if desired, with a small protuberance or hump 126, 128 for a purpose similar to the aforementioned protuberances on the label holders.

In use of the shelf divider system as seen in FIG. 9, a pair of universal support elements 20*a*, 20*b* are affixed in spaced relationship to the upper surface 106 of the shelf 108, extending generally parallel to each other and to the front and rear edges 110, 112 of the shelf 108, with their respective channels 39 opening toward each other. The opposed end portions or mounting elements 122, 124 of each shelf divider 115 are slidingly engaged under the flexible finger(s) of each support element as shown in the left-hand portion of FIG. 9, to provide perpendicularly extending divider members 118 as seen in the right-hand portion of FIG. 9, at desired locations.

Obviously, with the shelf divider system of the instant invention, it is not necessary that the support members 20*a*, 20*b* be positioned at the very front and the very back of the shelf 108, nor is it necessary that the shelf 108 include apertures formed therethrough. Further, because of the relative flatness of the universal support elements 20, they provide minimum interference when placing products on the shelf or removing products from the shelf, and they do not block product information or any significant portion of the products themselves from the consumer.

Due to the very thin nature of the die-cut dividers, which may be approximately 1/16" thick, they take up very little shelf space as compared to molded plastic or metal shelf dividers which are commonly three or four times that thick.

If desired, for the shelf divider system, a rigid plastic flange (not shown) may be provided that would be integral with or attached in any desired manner to the universal support element at the outside edge of the connection 26 to provide a barrier or fence at the front or rear edge of a shelf to keep products from falling off the shelf, particularly when the rear end of the shelf is open, or when the shelf surface is slanted or disposed at an angle to the horizontal.

From a consideration of the foregoing, it is seen at that the objects of the instant invention outlined above, and other features and advantages hereof, are met. While preferred embodiments of the instant invention have been described and illustrated herein, it will be clear that variations of the details of construction which are specifically shown and described, may be resorted to without departing from the true spirit and scope of the invention as defined in the appended claims.

We claim:

1. An elongated universal support element comprising:

a mounting portion and a cover portion each of which has an inner and an outer surface and spaced inner and outer longitudinally extending edges, the spacing between said inner and outer edges of said mounting portion being the width of said mounting portion, the spacing between said inner and outer edges of said cover portion being the width of said cover portion, said mounting portion and said cover portion being integrally connected to each other along their respective inner edges with their outer edges extending freely, the width of said cover portion being greater than the width of said mounting portion, whereby said cover portion includes a first part which is connected to, and overlies, said mounting portion with the inner surfaces of said mounting portion and said cover portion facing each other to together define a generally V-shaped channel member, and a second part which extends beyond said outer edge of said mounting portion, said mounting portion being adapted to be affixed to a mounting surface with its outer surface juxtaposed thereto, a finger member having a base portion carried by said inner surface of said second part of said cover portion adjacent said outer edge thereof, said finger member having a flexible terminal portion, said finger member having a height between said base portion and said flexible terminal portion greater than the distance between said base portion and a plane which is an extension of said outer surface of said mounting portion, whereby said terminal portion of said finger member is adapted to flex when it engages a mounting surface to which said outer surface of said mounting portion is affixed to thereby removably capture portions of an item to be supported by said support element between the mounting surface and said finger member carried by said second part of said cover member, further including an upwardly extending flange carried by said outer edge of said mounting portion to act as a stop for portions of an item engaged between said second part of said cover portion and the mounting surface.

2. The support element of claim 1, further including adhesive means carried by said outer surface of said mounting portion to affix said support element to the mounting surface.

3. The support element of claim 1 wherein said finger member comprises an elongated flexible finger integral with said second part of said cover portion, said finger having a longitudinal axis extending generally parallel to, and spaced inwardly of, said outer edge of said cover portion.

4. The support element of claim 3 including a further elongated flexible finger integral with said inner surface of said second part of said cover portion, each of said fingers having a longitudinal axis extending generally parallel to said outer edge of said cover portion and being spaced therefrom and from each other to define a groove between them for reception of a protuberance on the item to be supported by said support element.

5. The support element of claim 1 wherein said cover portion is generally V-shaped with an apex overlying said outer edge of said mounting portion, said terminal portions of said finger member being biased toward the supporting surface.

6. The support element of claim 1, further including an upturned lip on said second edge of said cover portion to facilitate sliding a portion of an item to be supported by said support element between the mounting surface and said cover portion.

7. In combination a mounting surface, a support element comprising a mounting portion and a cover portion each of which has an inner and an outer surface and spaced inner and an outer longitudinally extending edges, the spacing between said inner and outer edges of said mounting portion being the width of said mounting portion, the spacing between said inner and outer edges of said cover portion being the width of said cover portion, said mounting portion and said cover portion being integrally connected to each other along their respective inner edges with their outer edges extending freely, the width of said cover portion being greater than the width of said mounting portion, whereby said cover portion includes a first part which is connected to, and overlies, said mounting portion with the inner surfaces of said mounting portion and said cover portion facing each other to together define a generally V-shaped channel member, and a second part which extends beyond said outer edge of said mounting portion, said mounting portion being affixed to said mounting surface with its outer surface juxtaposed thereto, a finger member having a base portion carried by said inner surface of said second part of said cover portion adjacent said outer edge thereof, said finger member having a flexible terminal portion, said finger member having a height between said base portion and said flexible terminal portion greater than the distance between said base portion and said mounting surface, and an item supported between said mounting surface and said finger member carried by said second part of said cover member, said mounting surface including a generally horizontally extending shelf having an elongated front edge and an undersurface, said support element being affixed to said undersurface of said shelf with said outer edge of said cover portion juxtaposed to said front edge of said shelf, said item supported thereby being a label holder, said label holder including a mounting element movably captured between said flexible terminal portion of said finger member and said undersurface of said shelf, and a label-holding element extending at an angle from said mounting element, said mounting element and said label-holding element of said label holder extending generally perpendicular to each other.

8. The combination of claim 7 wherein said mounting surface extends generally vertically, said support element being affixed thereto generally horizontally with said outer edge of said cover portion below said inner edge, and said item supported thereby is a sheet of material having upper edge portions removably captured between said flexible terminal portion of said finger member and said mounting surface.

9. The combination of claim 7 wherein said mounting surface includes a generally horizontally extending shelf having an elongated front edge and an undersurface, said support element being affixed to said undersurface of said shelf with said outer edge of said cover portion juxtaposed to said front edge of said shelf.

10. In combination a mounting surface, a support element comprising a mounting portion and a cover portion each of which has an inner and an outer surface and spaced inner and an outer longitudinally extending edges, the spacing between said inner and outer edges of said mounting portion being the width of said mounting portion, the spacing between said inner and outer edges of said cover portion being the width of said cover portion, said mounting portion and said cover portion being integrally connected to each other along their respective inner edges with their outer edges extending freely, the width of said cover portion being greater than the width of said mounting portion, whereby said cover portion includes a first part which is connected to, and overlies, said mounting portion with the inner surfaces of said mounting portion and said cover portion facing each other to together define a generally V-shaped channel member, and a second part which extends beyond said outer edge of said mounting portion, said mounting portion being affixed to said mounting surface with its outer surface juxtaposed thereto, a finger member having a base portion carried by said inner surface of said second part of said cover portion adjacent said outer edge thereof, said finger member having a flexible terminal portion, said finger member having a height between said base portion and said flexible terminal portion greater than the distance between said base portion and said mounting surface and an item supported between said mounting surface and said finger member carried by said second part of said cover member, said item supported thereby being a label holder, said label holder including a mounting element movably captured between said flexible terminal portion of said finger member and said mounting surface, and a label-holding element, said label-holding element of said label holder including a transparent front panel integrally connected to said mounting element along a common edge, and a reverted portion integrally connected to said panel in spaced relation to said common edge to form a pocket behind said transparent panel for removable reception of a non-adhesive label.

11. In combination a mounting surface, a support element comprising a mounting portion and a cover portion each of which has an inner and an outer surface and spaced inner and an outer longitudinally extending edges, the spacing between said inner and outer edges of said mounting portion being the width of said mounting portion, the spacing between said inner and outer edges of said cover portion being the width of said cover portion, said mounting portion and said cover portion being integrally connected to each other along their respective inner edges with their outer edges extending freely, the width of said cover portion being greater than the width of said mounting portion, whereby said cover portion includes a first part which is connected to, and overlies, said mounting portion with the inner surfaces of said mounting portion and said cover portion facing each other to together define a generally V-shaped channel member, and a second part which extends beyond said outer edge of said mounting portion, said mounting portion being affixed to said mounting surface with its outer surface juxtaposed thereto, a finger member having a base portion carried by said inner surface of said second part of said cover portion adjacent said outer edge thereof, said finger member having a flexible terminal portion, said finger member having a height between said base portion and said flexible terminal portion greater than the distance between said base portion and said mounting surface and an item supported between said mounting surface and said finger member carried by said second part of said cover member, said item supported thereby being a label holder, said label holder including a mounting element movably captured between said flexible terminal portion of said finger member and said mounting surface, and a label-holding element, said mounting element of said label-holding element including a freely extending terminal edge, a protuberance formed in said mounting element spaced from said terminal edge, said protuberance being received between said inner surface of said second part of said cover portion and said mounting surface behind said finger member.

12. The combination of claim 11 wherein said finger member comprises an elongated flexible finger, said support element including a further elongated flexible fingers, each of said fingers being integral with said inner surface of said second part of said cover portion, each of said fingers having a longitudinal axis extending generally parallel to said outer edge of said cover portion and being spaced therefrom and from each other to define between them a groove, said protuberance being an elongated hump extending generally parallel to said terminal edge of said mounting element and received within said groove.

* * * * *